US010307772B2

(12) United States Patent
Xiang et al.

(10) Patent No.: US 10,307,772 B2
(45) Date of Patent: Jun. 4, 2019

(54) SPRAYING DEVICE

(71) Applicants: BOE TECHNOLOGY GROUP CO., LTD., Beijing (CN); CHENGDU BOE OPTOELECTRONICS TECHNOLOGY CO., LTD., Sichuan (CN)

(72) Inventors: Chen Xiang, Beijing (CN); Liwei Fan, Beijing (CN); Libo Chen, Beijing (CN); Feng Luo, Beijing (CN)

(73) Assignees: BOE TECHNOLOGY GROUP CO., LTD., Beijing (CN); CHENGDU BOE OPTOELECTRONICS TECHNOLOGY CO., LTD., Sichuan (CN)

( * ) Notice: Subject to any disclaimer, the term of this patent is extended or adjusted under 35 U.S.C. 154(b) by 90 days.

(21) Appl. No.: 15/526,347

(22) PCT Filed: Jul. 8, 2016

(86) PCT No.: PCT/CN2016/089405
§ 371 (c)(1),
(2) Date: May 12, 2017

(87) PCT Pub. No.: WO2017/152560
PCT Pub. Date: Sep. 14, 2017

(65) Prior Publication Data

US 2018/0078957 A1 Mar. 22, 2018

(30) Foreign Application Priority Data

Mar. 7, 2016 (CN) ..... 2016 2 0171721 U

(51) Int. Cl.
*B05B 3/00* (2006.01)
*B05B 3/08* (2006.01)
(Continued)

(52) U.S. Cl.
CPC ..... *B05B 3/08* (2013.01); *B05B 3/12* (2013.01); *B08B 3/02* (2013.01); *B08B 3/022* (2013.01);
(Continued)

(58) Field of Classification Search
CPC .... B05B 3/08; B05B 3/12; B05B 3/02; B05B 3/002
(Continued)

(56) References Cited

U.S. PATENT DOCUMENTS 287,508 A * 10/1883 Didiot ..... B05B 3/02 239/225.1
435,878 A * 9/1890 Dunton ..... B05B 3/02 239/214
(Continued)

FOREIGN PATENT DOCUMENTS

CN 1307254 A 8/2001
CN 103316862 A 9/2013
(Continued)

OTHER PUBLICATIONS

International Search Report for International Application No. PCT/CN2016/089405 dated Dec. 1, 2016.

*Primary Examiner* — Viet Le
(74) *Attorney, Agent, or Firm* — Calfee, Halter & Griswold LLP

(57) ABSTRACT

A spraying device, which includes a spraying mechanism and a rotating mechanism is disclosed. The rotating mechanism includes a rotating sidewall, which sidewall is provided with multiple sets of spraying holes arranged along the circumference of the rotating sidewall. Each set of spraying holes includes a plurality of spraying holes, and the spraying holes of at least two adjacent sets of spraying holes are arranged in a staggered arrangement. The spraying mecha-
(Continued)

nism includes an infusion channel, the sidewall of which is provided with a spraying spout. The infusion channel extends along the inside of the rotating sidewall, the rotating sidewall being configured to rotate or swing with respect to the spraying spout of the infusion channel.

16 Claims, 12 Drawing Sheets

(51) Int. Cl.
*B08B 11/04* (2006.01)
*B08B 3/02* (2006.01)
*B05B 3/12* (2006.01)
*B05B 3/02* (2006.01)
*B05B 15/14* (2018.01)

(52) U.S. Cl.
CPC ..... *B08B 11/04* (2013.01); *B05B 3/021* (2013.01); *B05B 15/14* (2018.02)

(58) Field of Classification Search
USPC ..... 239/380, 214.15, 214.19, 224, 504, 538, 239/539, 223
See application file for complete search history.

(56) References Cited

U.S. PATENT DOCUMENTS 497,413 A * 5/1893 Ruble ..... B05B 3/02 239/225.1
1,299,380 A * 4/1919 Plumer ..... B05B 3/06 239/253
1,427,559 A * 8/1922 Sonsthagen ..... B05B 3/02 159/3
2,668,079 A * 2/1954 Menegus ..... B05B 3/02 239/7
2,695,002 A * 11/1954 Miller ..... B05B 3/14 118/626
2,734,480 A * 2/1956 Norris ..... B05B 3/02 118/326
2,865,325 A * 12/1958 Leston ..... B05B 3/02 118/300
2,912,170 A * 11/1959 English ..... B05B 3/02 239/215
2,913,232 A * 11/1959 Silverman ..... B01D 47/10 239/380
2,919,861 A * 1/1960 Meek ..... B05B 3/12 239/261
2,954,934 A * 10/1960 Hatanaka ..... B05B 3/06 239/231
2,955,765 A * 10/1960 Farmer ..... B05B 1/046 239/263.2
2,994,482 A * 8/1961 Valois ..... B05B 3/02 239/117
3,009,651 A * 11/1961 Wolf ..... A01G 25/00 239/222.13
3,140,051 A * 7/1964 Moore ..... B05B 3/02 239/215
3,146,953 A * 9/1964 Komanns ..... A47L 15/22 239/102.1
3,220,653 A * 11/1965 Waldrum ..... B05B 3/02 239/222
3,266,737 A * 8/1966 Nees ..... B05B 1/04 239/504
3,299,853 A * 1/1967 Whitacre ..... B05B 3/02 118/312
3,353,752 A * 11/1967 Ranhagen ..... B01D 21/0012 239/380
3,402,725 A * 9/1968 Booth ..... B05B 3/02 134/167 R
3,504,859 A * 4/1970 Yetman ..... B01F 3/04035 159/4.2
3,556,407 A * 1/1971 Iwajiro Niikura ..... B05B 3/02 239/227
3,724,760 A * 4/1973 Smith ..... B05B 1/1672 239/282
3,741,808 A * 6/1973 Stalker ..... B05B 3/02 134/167 R
3,880,357 A * 4/1975 Baisch ..... B05B 3/14 239/225.1
3,881,655 A * 5/1975 Mimeur ..... B05B 3/0422 239/240
4,010,966 A * 3/1977 Vanden Bosch ..... E21B 17/046 285/403
4,043,295 A * 8/1977 Speck ..... B05B 3/02 118/317
4,078,725 A * 3/1978 Bauer ..... B05B 3/02 118/DIG. 16
4,079,968 A * 3/1978 Wilkins, Jr. ..... F16L 37/086 285/187
4,252,763 A * 2/1981 Padgett ..... B28B 19/0023 239/214
4,272,025 A * 6/1981 Mazzotti ..... B05B 3/0427 239/240
4,557,218 A * 12/1985 Sievers ..... D06B 19/0094 118/410
4,632,313 A * 12/1986 Rinkewich ..... B05B 1/1654 137/624.14
4,945,933 A * 8/1990 Krajicek ..... B05B 3/02 134/167 R
4,984,743 A * 1/1991 Chaddock ..... B05B 3/02 239/559
4,997,129 A * 3/1991 Waldrum ..... B05B 3/02 239/154
5,093,943 A * 3/1992 Wei ..... B05B 1/1636 4/615
5,268,195 A * 12/1993 Weisskopf ..... B05B 3/02 118/308
5,314,119 A * 5/1994 Watt ..... B05B 3/08 101/363
5,316,218 A * 5/1994 Bowen ..... B05B 13/0636 239/246
5,421,517 A * 6/1995 Knudson ..... B05B 3/02 239/225.1
5,582,742 A * 12/1996 Wilkie ..... B04B 11/06 210/360.1
5,730,366 A * 3/1998 DeWitt ..... B05B 1/20 239/242
5,765,581 A * 6/1998 Badger ..... B05B 1/16 134/198
6,028,016 A * 2/2000 Yahiaoui ..... A61F 13/8405 442/118
6,044,869 A * 4/2000 Koob ..... E04B 1/6816 138/103
6,302,335 B1 * 10/2001 Ormiston ..... B05B 1/207 239/276
6,568,413 B1 * 5/2003 Hurskainen ..... B05B 3/02 134/166 R
6,651,681 B1 * 11/2003 Hurskainen ..... B08B 3/02 134/167 R
6,807,770 B2 * 10/2004 Wainwright ..... A01G 31/02 239/214
8,136,744 B2 * 3/2012 Gerard ..... B05B 15/70 239/281
2006/0278258 A1 12/2006 Kara et al.
2008/0001005 A1 * 1/2008 Weaver ..... B05B 3/021 239/225.1
2009/0179006 A1 * 7/2009 Lang ..... C23F 1/02 216/83
2010/0206962 A1 * 8/2010 Nolte ..... B05B 3/001 239/223
2010/0301139 A1 * 12/2010 Achord ..... B08B 3/024 239/380
2013/0008979 A1 * 1/2013 Lange ..... B05B 3/0427 239/380
2013/0153681 A1 * 6/2013 Mitsui ..... B05B 3/1014 239/225.1

(56) References Cited

U.S. PATENT DOCUMENTS

| | | | | |
|---|---|---|---|---|
| 2013/0200176 | A1* | 8/2013 | Alcamo | B05B 1/14 239/245 |
| 2013/0255733 | A1 | 10/2013 | Ju et al. | |
| 2014/0251206 | A1* | 9/2014 | Kim | B05B 13/0636 118/306 |
| 2014/0319248 | A1* | 10/2014 | Kinle | B05B 1/1636 239/443 |
| 2015/0034136 | A1* | 2/2015 | Bakke | B05B 1/083 134/167 C |
| 2015/0343477 | A1* | 12/2015 | Johnson | B05B 3/02 239/1 |
| 2016/0250670 | A1 | 9/2016 | Ma et al. | |
| 2016/0367931 | A1* | 12/2016 | Yin | B05B 1/14 |
| 2018/0078957 | A1* | 3/2018 | Xiang | B05B 3/08 |

FOREIGN PATENT DOCUMENTS

| | | | |
|---|---|---|---|
| CN | 103356143 | A | 10/2013 |
| DE | 102005026558 | B3 | 11/2006 |

* cited by examiner

SPRAYING DEVICE

RELATED APPLICATIONS

The present application is the U.S. national phase entry of PCT/CN2016/089405, with an international filing date of Jul. 8, 2016, which claims the benefit of Chinese Patent Application No. 201620171721.3, filed on Mar. 7, 2016, the entire disclosures of which are incorporated herein by reference.

TECHNICAL FIELD

The present application relates to the field of cleaning equipment, and more particularly to a spraying device.

BACKGROUND

In the automatic production line of a display device such as a Thin Film Transistor Liquid Crystal Display (TFT-LCD), it is usually necessary to clean the material such as a glass substrate, a substrate for forming a certain film, and other raw materials. By way of example, a spraying device may be used to clean the materials or the like.

In the prior art, it is common to use a stationary spraying device to clean the material or the like. The stationary spraying device comprises a spraying pipe which is closed at one end and is open at the other end, and a plurality of spraying holes are arranged on the side of the spraying pipe, and a control valve is arranged on the side of the stationary pipe near the open end. When the material to be cleaned is cleaned with the stationary spraying device, the material to be cleaned is placed in the spraying room, and the stationary spraying device is fixed in the spraying room so that the spraying holes on the spraying pipe faces the material to be cleaned. And then the control valve is opened, and liquid in the reservoir enter the spraying pipe through the open end of the spraying pipe, and is sprayed onto the material to be cleaned through the spraying holes of the spraying pipe to clean the material to be cleaned.

During practice, the inventor have found that the prior art has at least the following problems: the spraying holes of the stationary spraying device are exactly the spraying spout of the stationary spraying device, and since the spraying spout is fixed on the side of the spraying pipe, the liquid is usually sprayed from the spraying spout to the fixed area on the material to be cleaned, resulting in poor uniformity of the liquid spraying onto the material to be cleaned and poor cleaning effect of the stationary spraying device.

In another prior art, the spraying device comprises a swing-type spraying device. In the swing-type spraying device the swing structure is added on the basis of a stationary spraying device, which structure can make the spraying spout to swing. However, the spraying trajectory of the swing-type spraying device spraying onto the material to be cleaned is usually sinusoidal, the liquid spraying uniformity is poor, and the swing-type spraying device needs to continually swing. During the swing process, the spraying device need to do acceleration or deceleration movement, and thus the swing-type spraying device has large vibration, affecting the yield of products. And because of the need for swing, wear of the device is also larger.

SUMMARY

An embodiment of the present disclosure provides a spraying device comprising a spraying mechanism and a rotating mechanism, which rotating mechanism comprises a rotating sidewall, which sidewall is provided with multiple sets of spraying holes arranged along the circumference of the rotating sidewall. Each set of spraying holes comprises a plurality of spraying holes, and the spraying holes of at least two adjacent sets of spraying holes are arranged in a staggered arrangement. The spraying mechanism comprises an infusion channel, the sidewall of which is provided with a spraying spout. The infusion channel extends along the inside of the rotating sidewall, the rotating sidewall being configured to rotate or swing with respect to the spraying spout of the infusion channel.

In some embodiments, the rotating sidewall has a barrel structure or a prismatic structure or an arc sidewall having a radian, and the plurality of spraying holes in each set of spraying holes are arranged along the lengthwise direction of the rotating sidewall.

In some embodiments, the infusion channel has a round tubular structure with one end open and the other end closed, and the spraying spout is an elongated spraying spout with a lengthwise direction parallel to the lengthwise direction of the infusion channel.

In some embodiments, the lengthwise direction of the infusion channel is parallel to the lengthwise direction of the rotating sidewall, and the rotating sidewall is configured to rotate or swing relative to the spraying spout of the infusion channel to make the spraying spout to align with the different set of spraying holes at different times.

In some embodiments, the infusion channel is provided with a spraying member comprising a first opening and a second opening and a closed sidewall, the first opening connecting the spraying spout, the second opening facing the rotating sidewall.

In some embodiments, the spraying member has an elongated structure and has a fan-shaped cross-section in a direction perpendicular to the lengthwise direction of the infusion channel.

In some embodiments, the edge of the second opening in the spraying member is provided with a wear-resistant member, and the spraying spout is in contact with the rotating sidewall through the wear-resistant member.

In some embodiments, the spraying holes are evenly distributed on the rotating sidewall.

In some embodiments, the second opening is an elongated opening, the length of the second opening being less than or equal to the length of the rotating sidewall.

In some embodiments, an angle adjustment mechanism is disposed on the infusion channel for adjusting the spray angle of the spraying spout of the infusion channel.

In some embodiments, the spraying device further comprises: a drive mechanism for driving the rotating sidewall to rotate.

In some embodiments, the spraying device further comprises a first support frame and a second support frame, the first support frame being provided with a first retaining ring, the second support frame being provided with a second retaining ring; wherein the infusion channel comprises a closed end secured to the first support frame by means of the first retaining ring, and an open end secured to the second support frame by means of the second retaining ring.

In some embodiments, the spraying device further comprises a connecting tube and a control valve, the infusion channel comprising a closed end and an open end, the open end connecting to one end of the connecting pipe, and the control valve is arranged on the connecting pipe; when the spraying device is in operation, the open end is communicated with the reservoir through the connecting pipe, and the control valve is used to control the flow of the sprayed liquid.

In some embodiments, the spraying device further comprises: a first bearing, a second bearing and a first end cover, a second end cover, the closed end of the infusion channel being connected to the first bearing, the open end of the infusion channel being connected to the second bearing, the first bearing and the second bearing being respectively provided in center holes of the first end cover and the third end cover, the first end cover and the third end cover being respectively fixedly connected to the rotating sidewall.

In some embodiments, the spraying device further comprises a transmission mechanism disposed on the first end cover or the third end cover and a drive mechanism for driving the rotating sidewall through the transmission mechanism.

In some embodiments, the transmission mechanism is a gear or pulley, and the transmission mechanism is fixedly connected to the first end cover or the third end cover by key-and-slot connection.

The technical solution provided by the application has the beneficial effect that the liquid can be sprayed from the different set of spray hole at different times because the spraying spout is aligned with the different sets of spray holes at different times, so that the liquid is sprayed on different areas of the material to be cleaned; therefore, the uniformity of the sprayed liquid is better, and the cleaning effect is better.

It is to be understood that both the foregoing general description and the following detailed description are exemplary only and do not limit the invention.

BRIFE DESCRIPTION OF DRAWINGS

In order to more clearly illustrate the technical solution in the embodiments of the present disclosure, the drawings which are to be used in the description of the embodiments will be briefly introduced. It will be apparent that the drawings in the following description are merely examples of the present disclosure. It will be apparent to those skilled in the art that other drawings may be obtained from these drawings without expending any creative work.

The drawings herein are incorporated into and constitute a part of this specification, showing embodiments according to the disclosure and together with the description serve to explain the principles of the disclosure.

DETAILED EMBODIMENTS

In order to make the objects, technical solutions and advantages of the present disclosure to become more apparent, the present disclosure will be described in detail below in connection with the accompanying drawings. It is apparent that the described embodiments are merely part of the embodiments of the disclosure and are not all of the embodiments. All other embodiments obtained by those ordinary skilled in the art based on embodiments in the present disclosure without making creative work belong to the protection scope of the present disclosure.

Figure 1:
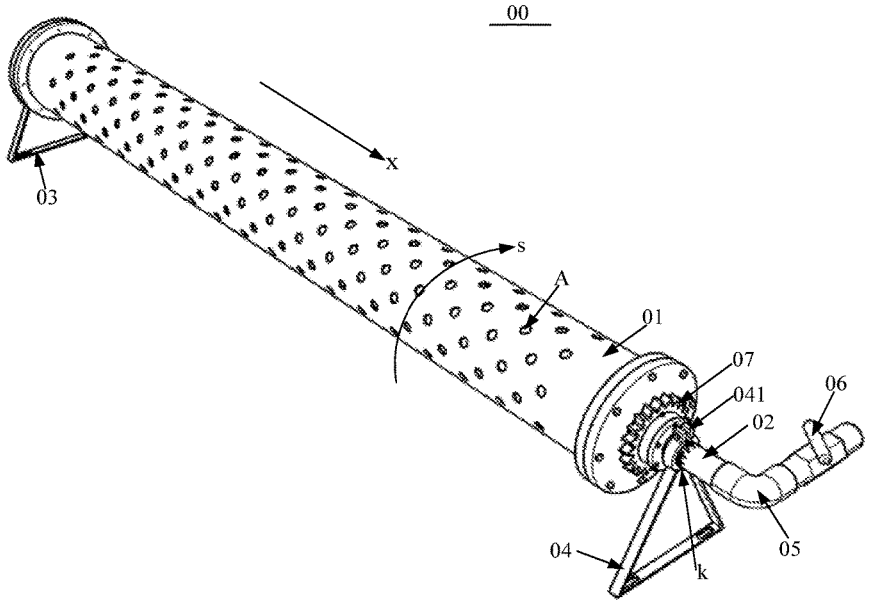
FIG. 1 is a schematic view of a three-dimensional structure of a spraying device provided by an embodiment of the present disclosure.

Referring to FIG. 1, there is shown a schematic view of a three-dimensional structure of a spraying device 00 according to an embodiment of the present disclosure. The spraying device 00 can be used for cleaning a material such as a glass substrate, in an automated production line of a display device. Referring to FIG. 1, the spraying device 00 mainly comprises a spraying mechanism and a rotating mechanism.

The rotation mechanism comprises a rotating sidewall 01 on which multiple sets of spraying holes (not shown in FIG. 1) arranged along the circumference of the rotating sidewall 01 are provided. Each set of spraying holes comprises a plurality of spraying holes A, such as a row of spraying holes A. The spraying holes A in at least two adjacent sets of spraying holes are arranged in a staggered arrangement.

The spraying mechanism comprises an infusion channel 02, the sidewall of which is provided with a spraying spout (not shown in FIG. 1).

The infusion channel 02 extends along the interior of the rotating sidewall 01, and the rotating sidewall 01 is able to align the spraying spout with the different sets of spraying holes at different times by rotation. Here, the rotational direction of the rotating sidewall 01 may be the direction s shown in FIG. 1, and of course, it may be a direction opposite to the direction s.

In view of the above, the spraying device provided by the embodiment of the present disclosure has the advantage that the liquid can be sprayed from different sets of spraying holes at different times since the spraying spout is aligned with different sets of spray holes at different times, so that the liquid is sprayed to the different areas of the material to be cleaned, therefore, the uniformity of liquid spraying is better, and the cleaning effect is better.

Further, continually referring to FIG. 1, the rotating sidewall 01 has a barrel structure. A plurality of spraying holes A are arranged along the lengthwise direction (i.e., longitudinal direction) x of the rotating sidewall 01, and the plurality of spraying holes in each set are evenly distributed on the rotating sidewall 01 (i.e., there is an equal spacing therebetween). The infusion channel 02 has a round tubular structure one end of which is open to and the other end of which is closed, and the spraying spout is an elongated spraying spout having a lengthwise direction parallel to the lengthwise direction of the infusion channel 02. The lengthwise direction of the infusion channel 02 is parallel to the lengthwise direction x of the rotating sidewall 01, and the rotating sidewall 01 can be rotated about the axis (not is shown in FIG. 1) of the barrel-shaped rotating sidewall 01 so that the spraying spout is aligned with the different set of spraying holes at different times.

Optionally, the spraying device 00 further comprises an angle adjusting mechanism (not shown in FIG. 1) provided on the infusion channel 02 for adjusting the spraying angle of the spraying spout of the infusion channel 02. By way of example, the angle adjustment mechanism may drive the infusion channel 02 to rotate about the axis of the infusion channel 02 so that the spraying angle (or orientation) of the spraying spout of the infusion channel 02 varies so as to achieve adjustment of the spraying angle. Therein the angle adjusting mechanism may be an external handle or a motor, the handle is used for adjusting the spraying angle of the spraying spout in an artificial manner, and the motor is used to adjust the spraying angle of the spraying spout electrically.

Figure 2:
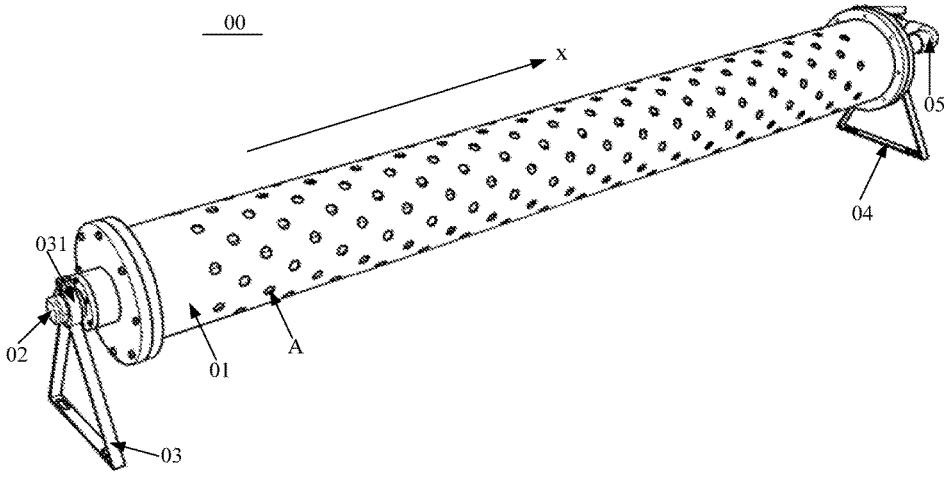
FIG. 2 is another schematic view of a three-dimensional structure of a spraying device provided by an embodiment of the present disclosure.

FIG. 2 shows another schematic view of a three-dimensional structure of a spraying device 00 provided by an embodiment of the present disclosure. Referring to FIGS. 1 and 2, the spraying device 00 further comprises a first support frame 03 and a second support frame 04. The first support frame 03 is provided with a first retaining ring 031 and a second retaining ring 041 is provided on the second support frame 04. The infusion channel 02 comprises a closed end and an open end, and the closed end of the infusion channel 02 is fixed to the first support frame 03 by the first retaining ring 031, and the open end is fixed to the second support frame 04 by the second retaining ring 041. Optionally, the open end of the infusion channel 02 is provided with an angular scale k arranged along the circumference of the infusion channel 02, and the second retaining ring 041 is provided with an opening (not shown in FIGS. 1 and 2). The opening may indicate the angle scale of the infusion channel 02, which indicates the angle of spraying of the spraying spout of the infusion channel 02.

Further, continually referring to FIGS. 1 and 2, the spraying device 00 may further comprise a connecting pipe 05 and a control valve 06. The open end of the infusion channel 02 is connected to one end of the connecting pipe 05, and the control valve 06 is provided on the connecting pipe 05. When the spraying device 00 is in operation, the open end of the infusion channel 02 is communicated with the reservoir (not shown in FIGS. 1 and 2) through the connecting pipe 05 so that the liquid in the reservoir enters the infusion channel 02 through the connecting pipe 05. The control valve 06 is used to control the flow of the liquid entering the infusion channel 02.

Further, continually referring to FIG. 1, the spraying device 00 may further comprise a first bearing (not shown in FIG. 1), a second bearing (not shown in FIG. 1), and a transmission mechanism 07. The closed end of the infusion channel 02 is connected to the first bearing, the open end is connected to the second bearing, and the infusion channel 02 is connected to the rotating sidewall 01 through the first bearing and the second bearing. The transmission mechanism 07 is, for example, a gear, and is fixed to the rotating sidewall 01 indirectly. In other embodiments, the transmission mechanism 07 may be a pulley or the like. Optionally, the spraying device 00 may also comprise a drive mechanism (not shown in FIG. 1) for rotating the rotation sidewall 01 by the gear 07. By way of example, the drive mechanism is used to rotate the rotating sidewall 01 about the axis of the rotating sidewall 01 by means of the gear 07 so that the spraying spout is aligned with the different sets of spraying holes at different times, and thus the liquid entering the infusion channel 02 through the connection pipe 05 enters the rotating sidewall 01 from the spraying spout of the infusion channel 02 and is sprayed from the different sets of spraying holes of the rotating sidewall 01.

Figure 3:
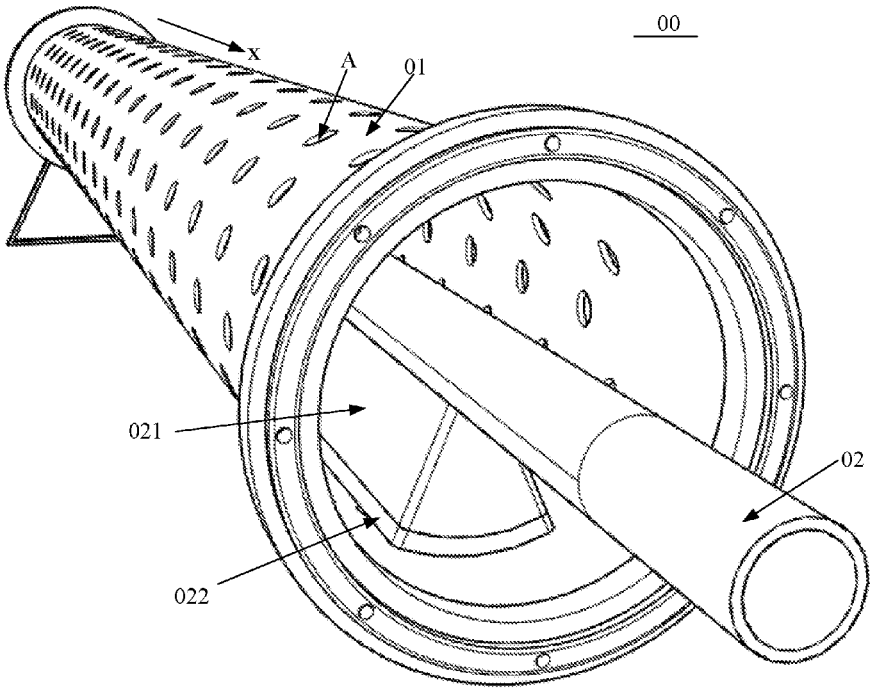
FIG. 3 is a schematic partial sectional view of a three-dimensional structure of a spraying device provided by an embodiment of the present disclosure.

Referring to FIG. 3, there is shown a partial three-dimensional schematic view of a spraying device 00 according to an embodiment of the present disclosure. Referring to FIG. 3, the infusion channel 02 is provided with a spraying member 021 which comprises a first opening (at one end near the infusion channel 02) and a second opening (near one end of the rotating sidewall 01) and a closed spraying sidewall (for connecting the first opening and the second opening). Therein the first opening connects the spraying spout on the infusion channel 02 and the second opening faces the rotating sidewall 01. Optionally, the spraying member 021 is of an elongated (long strip shaped) structure, and the spraying member 021 has a fan-shaped cross section in a plane perpendicular to its lengthwise direction. Therein the cross section of the spraying member 021 is in a plane on the spraying member 021 perpendicular to the lengthwise direction of the spraying member 021, and the lengthwise direction of the spraying member 021 is parallel to the lengthwise direction x of the rotation sidewall 01. By way of example, in the embodiment of the present disclosure, the spraying member 021 is welded (or connected in other connection way) to the infusion channel 02. Alternatively, the spraying member 021 and the infusion channel 02 are integrally formed by molding, and the embodiments of the present disclosure are not limited thereto.

Optionally, as shown in FIG. 3, the edge of the second opening on the spraying member 021 is provided with a sealing wear-resistant member 022, and the spraying member 021 is in contact with the rotating sidewall 01 by means of the sealing wear-resistant member 022. The provision of the sealing wear-resistant member 022 can prevent the spraying member 021 from being worn and improve the service life of the spraying member 021. Further, the sealing wear-resistant member 022 can maintain a certain degree of tightness between the spraying member 021 and the rotating sidewall 01, thereby making the sprayed liquid more stable.

Figure 4:
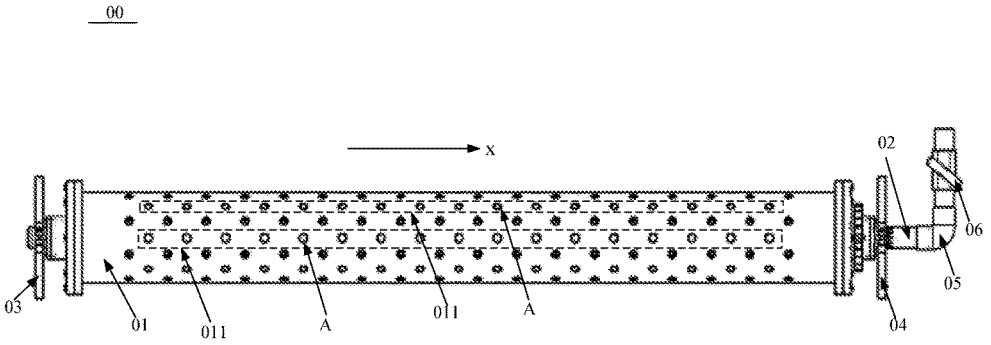
FIG. 4 is a plan view of a spraying device provided by an embodiment of the present disclosure.
Figure 5:
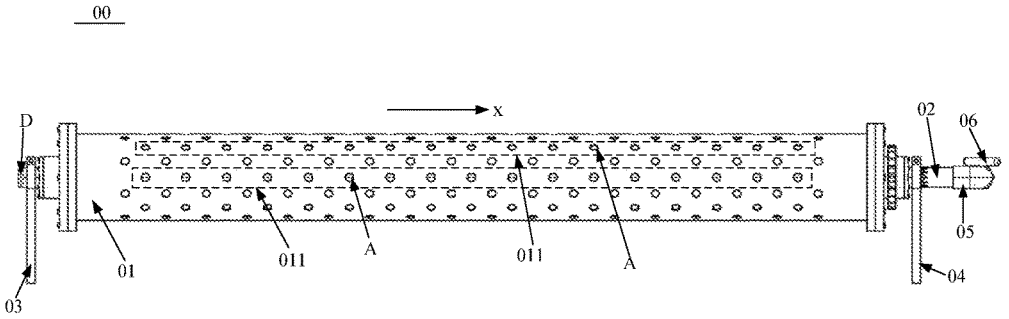
FIG. 5 is a bottom view of the spraying device provided in the embodiment shown in FIG. 4.

FIGS. 4 and 5 show a plan view of a spraying device 00 provided by an embodiment of the present disclosure, wherein FIG. 5 is a bottom view of the spraying device 00 provided in the embodiment shown in FIG. 4. As can be seen from FIG. 4 or FIG. 5, the spraying device 00 comprises a spray mechanism, a rotation mechanism, a first support frame 03, a second support frame 04, a connection pipe 05, and a control valve 06.

The spraying mechanism comprises an infusion channel 02 which is a circular tubular structure with one end open and one end closed. The sidewall of the infusion channel 02 is provided with a spraying spout which is a long stripe-shaped spraying spout (not shown in FIG. 4) having a lengthwise direction parallel to the lengthwise direction of the infusion channel 02.

The rotating mechanism comprises a rotating sidewall 01 which has, for example, a cylindrical structure, and a plurality of spraying hole sets 011 arranged along the circumference of the rotating sidewall 01 are provided on the rotating sidewall 01. Each set of spraying holes 011 comprises a plurality of spraying holes A. By way of example, the plurality of spraying holes A are arranged along the lengthwise direction x of the rotating sidewall 01, and the spraying holes A in at least two adjacent spraying hole sets are staggered, and the spraying holes A are uniformly distributed on the rotation sidewall 01, so that the liquid can be uniformly sprayed from the rotating sidewall 01. Of course, the rotating sidewall 01 may not have a cylindrical structure, for example, it may have a prismatic structure. In a further embodiment, the rotating sidewall 01 may be an arc sidewall having a radian, which arc sidewall rotates or swings under an angle centered on the spraying member 021.

Referring to FIG. 4 or 5, the infusion channel 02 extends along the inside of the rotating sidewall 01, and the lengthwise direction of the infusion channel 02 is parallel to the lengthwise direction x of the rotating sidewall 01. The first support frame 03 is provided with a first retaining ring (not shown in FIG. 4 and FIG. 5), and a second retaining ring (not shown in FIG. 4 and FIG. 5) is provided on the second support frame 04. the closed end of the infusion channel 02 is fixed to the first support frame 03 by the first retaining ring, and the open end of the infusion channel 02 is fixed to the second support frame 04 by the second retaining ring, and the open end of the infusion channel 02 is connected to one end of the connecting pipe 05. And the control valve 06 is provided on the connecting pipe 05. When the spraying device 00 is in operation, the opening end of the infusion channel 02 is communicated with the reservoir (not shown in FIGS. 4 and 5) through the connecting pipe 05, and the control valve 06 is used to control the flow of liquid entering the infusion channel 02.

Figure 6:
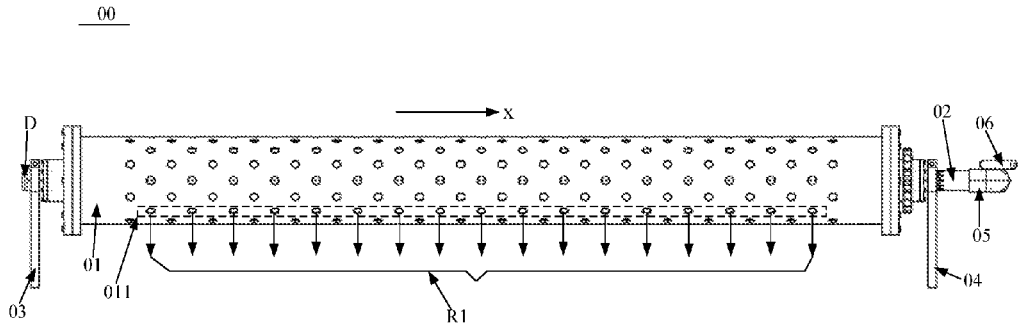
FIG. 6 is a schematic structural view of a spraying device provided by an embodiment of the present disclosure.
Figure 7:
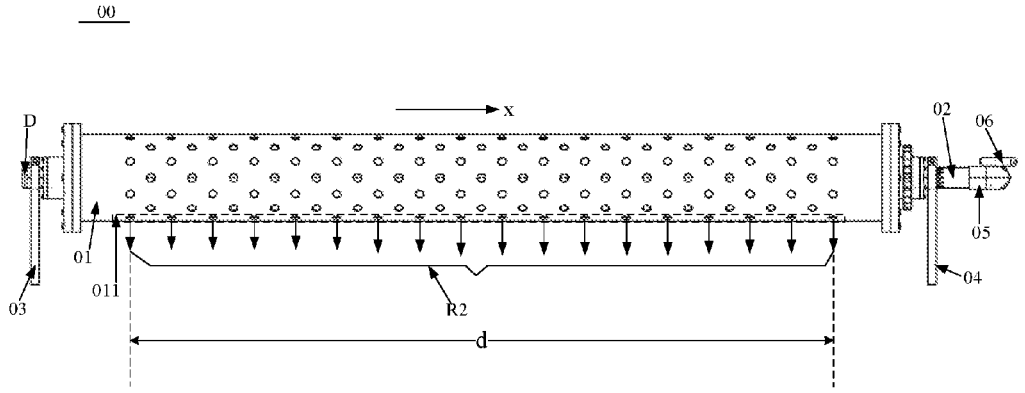
FIG. 7 is another schematic structural view of a spraying device provided by an embodiment of the present disclosure.

Optionally, the spraying device 00 also comprises a drive mechanism (not shown in FIGS. 4 and 5) for driving the rotating sidewall 01 to rotate through the gear 07. By way of example, under driving of the drive mechanism, the rotating sidewall 01 can be rotated about the axis of the rotating sidewall 01 so that the spraying spout is aligned with the different sets of spraying holes at different times. Since the spray holes A in at least two adjacent spray hole sets 011 of the rotating sidewall 01 are staggered, the liquid is sprayed from the different spraying hole sets 011 of the rotating sidewall 01, onto the different areas of the material to be cleaned, so that the liquid sprayed to the material to be cleaned is more uniform, and the cleaning effect is better. By way of example, as shown in FIG. 6, it is assumed that at a first moment the liquid is sprayed from the spraying holes A in the spraying hole set 011 shown in FIG. 6 and the rotation sidewall 01 is rotated in the direction s shown in FIG. 1, the liquid is sprayed from the spraying holes A in the spraying hole set 011 shown in FIG. 7 at a second moment. As shown in FIGS. 6 and 7, it can be seen that the spray holes A in the spraying hole set 011 shown in FIG. 6 is staggered with the spraying holes A in the spraying hole set 011 shown in FIG. 7. It is to be noted that R1 shown in FIG. 6 and R2 shown in FIG. 7 both indicate the spraying ranges of liquid.

Optionally, the infusion channel 02 is provided with a spraying member comprising a first opening and a second opening and a closed spraying sidewall. The first opening is connected to the spraying spout and the second opening faces the rotating sidewall 01, wherein the second opening is an elongated opening which has a length less than or equal to the length of the rotating sidewall 01. By way of example, the length of the second opening may be the length d shown in FIG. 7.

Figure 8:
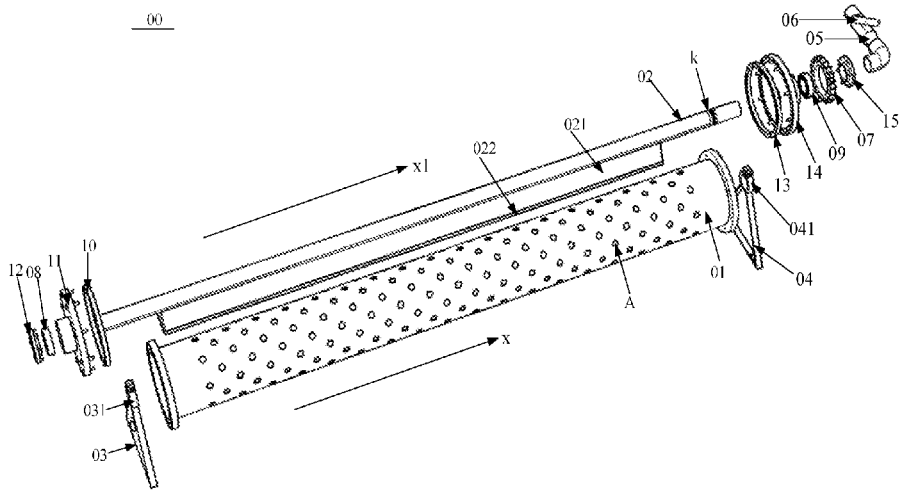
FIG. 8 is an exploded view of a spraying device provided by an embodiment of the present disclosure.
Figure 9:
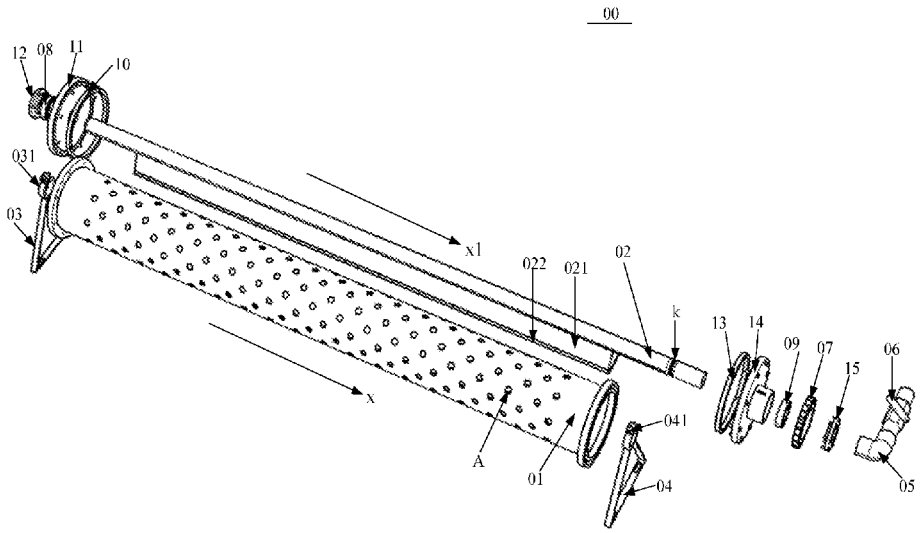
FIG. 9 is another exploded view of a spraying device provided by an embodiment of the present disclosure.
Figure 10:
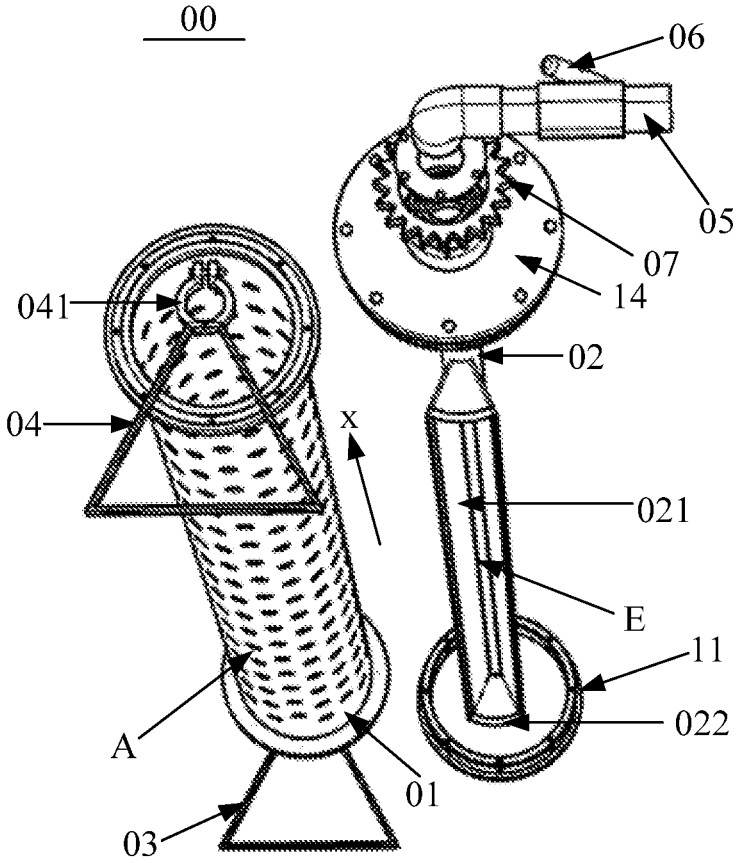
FIG. 10 is still another exploded view of a spraying device provided by an embodiment of the present disclosure.

FIGS. 8 to 10 show exploded views of a spraying device 00 provided by an embodiment of the present disclosure. See FIGS. 8 to 10, the spraying device 00 comprises a spraying mechanism, a rotation mechanism, a first support frame 03, a second support frame 04, a connection pipe 05, a control valve 06, a gear 07, a first bearing 08, and a second bearing 09.

The spraying mechanism comprises an infusion channel 02 which has a round tubular structure with one end open and the other end closed. The sidewall of the infusion channel 02 is provided with a spraying spout which may be an elongated opening having a lengthwise direction parallel to the lengthwise direction x1 of the infusion channel 02. By way of example, the spraying spout is an opening E as shown in FIG. 10. The infusion channel 02 is provided with a spraying member 021 which comprises a first opening and a second opening and a closed spraying sidewall. The first opening is connected to the spraying spout E, and the second opening faces the rotating sidewall 01. Optionally, the spraying member 021 is of the elongated structure, and the cross section of the spraying member 021 in a plane perpendicular to the lengthwise direction may be fan-shaped. The second opening is located on the fan-shaped curved surface, and the edge of the second opening is provided with a sealing wear-resistant member 022.

The rotating mechanism comprises a barrel-shaped rotating sidewall 01 which is, for example, a cylindrical structure in which a plurality of spraying hole sets arranged along the circumference of the rotating sidewall 01 are provided on the rotating sidewall 01 (not shown in FIGS. 8 to 10), and each set of the spraying holes has a plurality of spraying holes A. For example, a plurality of spraying holes in each of the spraying hole sets are arranged along the lengthwise direction of the rotation sidewall 01, and the spray holes A in at least two adjacent sets of spraying holes are staggered and the spray holes A are evenly distributed on the rotating sidewall 01.

Referring to FIG. 8, the closed end of the infusion channel 02 is connected to the first bearing 08, the open end is connected to the second bearing 09, and the infusion channel 02 is fixedly connected to the rotating sidewall 01 through the first bearing 08 and the second bearing 09. The gear 07 is indirectly connected to the rotating sidewall 01 and is connected to an external drive mechanism. Of course, as described above, the gear 07 is not limited to the form shown in the drawings, and may also be replaced by other drive members, such as pulleys. Optionally, as shown in FIG. 8, the spraying device 00 further comprises a first gasket 10, a first end cover 11, a second end cover 12, a second gasket 13, a third end cover 14, and a fourth end cover 15. The first end cover 11, the second end cover 12, the third end cover 14, and the fourth end cover 15 are provided with openings. The first support frame 03 is provided with a first retaining ring 031, a second retaining ring 041 is provided on the second support frame 04, and a control valve 06 is provided on the connecting pipe 05.

During assembling of the spraying device 00 as shown in FIGS. 8 to 10, the infusion channel 02 extends along the inside of the rotating sidewall 01, and both ends of the infusion channel 02 extend out from both ends of the rotating sidewall 01, respectively, and the lengthwise direction x1 of the infusion channel is parallel to the lengthwise direction x of the rotating sidewall 01. The spraying member 021 of the infusion channel 02 is brought into contact with the rotating sidewall 01 by the sealing wear-resistant member 022. The closed end of the infusion channel 02 passes through the first gasket 10, the first end cover 11, the first bearing 08 and the second end cover 12 and extends from the opening in the second end cover 12 and finally is fixed to the first support frame 03 through the first retaining ring 031. The first gasket 10 is disposed between the first end cover 11 and the first end of the rotating sidewall 01, and the first bearing 08 is disposed in the center hole of the first end cover 11. The first end cover 11 is fixedly connected to the first end of the rotating sidewall 01 by means of a screw (or other connection means) for rotatably securing the rotating sidewall 01 to the infusion channel 02 in cooperation with the first bearing 08 therein. The second end cover 12 is fixedly connected to the first end cover 11 by means of a screw (or other connection means) for axially fixing the first bearing 08 in the center hole of the first end cover 11. The opening end of the infusion channel 02 passes through the second gasket 13, the third end cover 14, the second bearing 09, the gear 07 and the fourth end cover 15 and extends from the opening in the fourth end cover 15, and are fixed to the second support frame 04 through the second retaining ring 041. The second gasket 13 is disposed between the third end cover 14 and the second end of the rotating sidewall 01. The second bearing 09 is provided in the center hole of the third end cover 14. The third end cover 14 is provided with a flat key J (shown in FIG. 16), and the gear 07 is fixedly connected to the third end cover 14 by a key-and-slot connection. The third end cover 14 is fixedly connected to the second end of the rotating sidewall 01 by means of a screw (or other connection means) for rotatably securing the rotating sidewall 01 to the infusion channel 02 in cooperation with the second bearing 09 therein. The fourth end cover 15 is fixedly connected to the third end cover 14 by means of a screw (or other connection means) for axially fixing the second bearing 09 in the center hole of the third end cover 14. Thus, the rotating sidewall 01 can be rotated about the axis of the rotating sidewall 01 (neither shown in FIGS. 8 to 10) so that the spraying spout of the infusion channel 02 is aligned with the different sets of spraying holes of the rotating sidewall 01 at different times. Among them, the provision of the sealing wear-resistant member 022 can prevent the spraying member 021 from being worn and improve the service life of the spraying member 021.

It should be noted that, as shown in FIG. 8 or 9, the open end of the infusion channel 02 is provided with an angle scale k arranged along the circumference of the infusion channel 02, and the second retaining ring 041 is provided with an indicator (for example, an opening or notch) which may indicate the angle scale of the infusion channel 02, the angle scale indicated by the indicator indicates the degree of the angle between the longitudinal axial cross section of the spraying member 021 of the infusion channel 02 and the vertical plane, and indicates the spraying angle of the spraying spout of the infusion channel 02.

Figure 11:
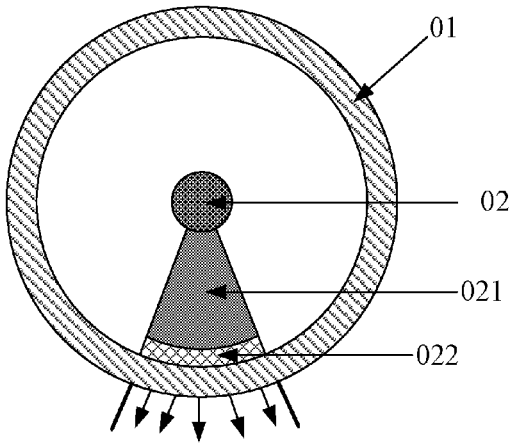
FIG. 11 is a diagram showing the relationship between a spray mechanism and a rotation mechanism provided by an embodiment of the present disclosure.
Figure 12:
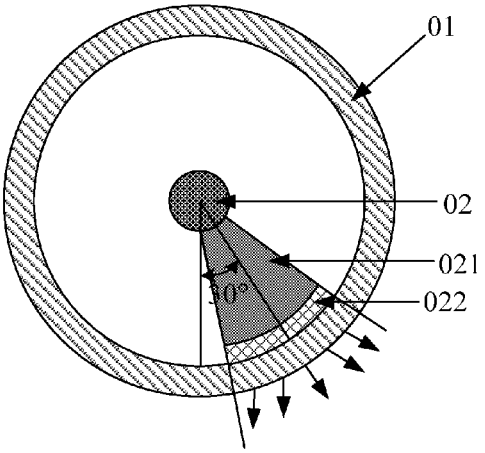
FIG. 12 is another diagram showing positional relationship between the spraying mechanism and the rotation mechanism provided by the embodiment of the present disclosure.

Optionally, an angle adjustment mechanism (e.g., a handle or a motor) is provided on the infusion channel 02, which can drive the infusion channel 02 to rotate about the axis of the infusion channel 02 so that the angle between the longitudinal axial cross section of the spraying member 021 of the infusion channel 02 and the vertical plane varies to achieve the adjustment of the spraying angle of the spraying spout of the infusion channel 02. By way of example, in an initial state, the angle scale indicated by the indicator on the second retaining ring 041 is 0 degree, and the positional relationship between the infusion channel 02 and the rotating sidewall 01 is shown in FIG. 11. At this time, the angle between the longitudinal axial cross section of the spraying member 021 and the vertical plane is equal to 0 degree. When the angle adjusting mechanism is actuated, for example, the angle scale indicated by the indicator on the second retaining ring 041 is 30 degrees, and the positional relationship between the infusion channel 02 and the rotating sidewall 01 is as shown in FIG. 12. Referring to FIG. 12, the angle between the longitudinal axial cross section of the spraying member 021 and the vertical plane is equal to 30 degrees. In the embodiment of the present disclosure, the angle of spraying of the infusion channel 02 in the vertical direction can be continuously and visually adjusted by setting the angle scale on the infusion channel 02 and setting the angle adjusting mechanism to drive the infusion channel 02 to rotate about the axis of the infusion channel 02. Preferably, it is necessary to release the first and second retaining rings firstly when the above-mentioned angle adjustment is required. And after the angle adjustment, the first and second retaining rings are locked to realize the stabilization of the infusion channel 02.

Figure 13:
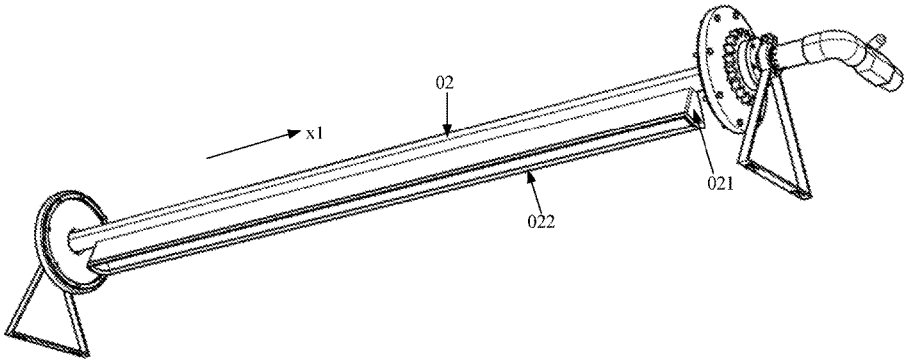
FIG. 13 is a schematic view of a spraying device according to an embodiment of the present disclosure after removal of the rotating sidewall.
Figure 14:
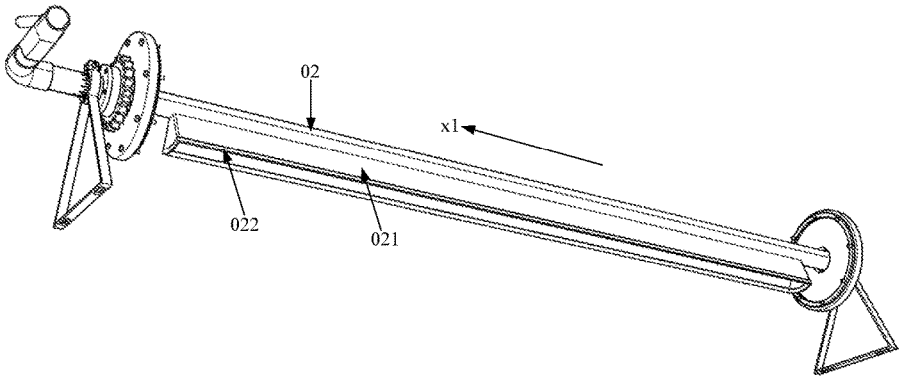
FIG. 14 is another schematic view of a spraying device provided by an embodiment of the present disclosure after removal of the rotating sidewall.

FIGS. 13 and 14 are schematic views of the spraying device 00 provided by the embodiment of the present disclosure after the removal of the rotating sidewall 01. Referring to FIG. 13 or FIG. 14, the spraying mechanism comprises an infusion channel 02 on the sidewall of which a spraying spout is provided. The spraying spout may be an elongated spraying spout having a lengthwise direction same as the lengthwise direction of the infusion channel 02. The infusion channel 02 is provided with a spraying member 021 which comprises a first opening and a second opening and a closed spraying sidewall. The first opening is connected to the spraying spout and the second opening faces the rotating sidewall. And the spraying member 021 may have a long strip-like structure, in which the cross section of the spraying member 021 is fan-shaped, and the second opening is located on the fan-shaped curved surface, and the edge of the second opening is provided with a sealing wear-resistant member 022.

Figure 15:
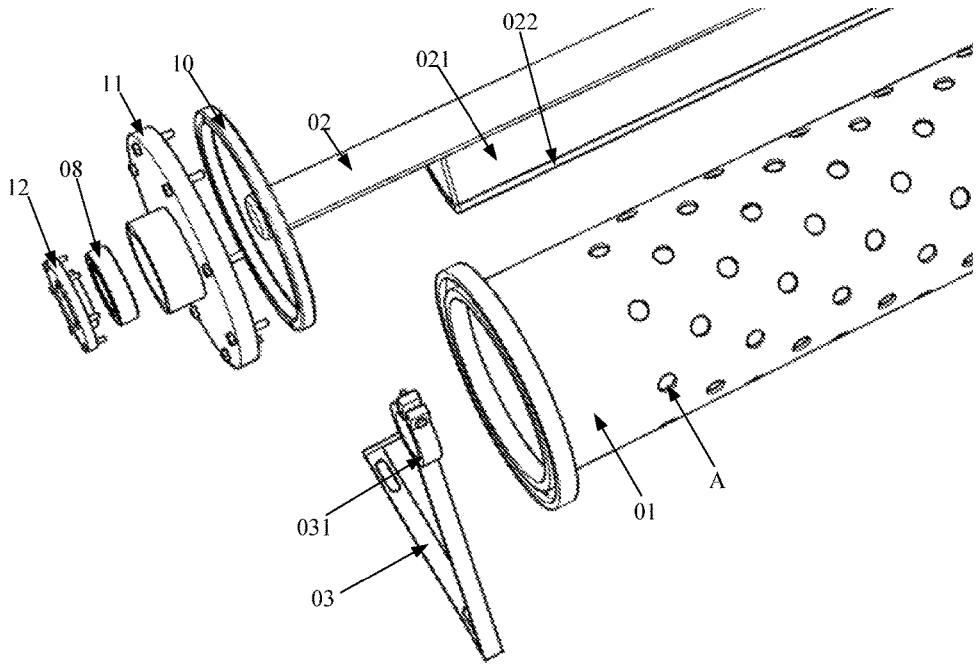
FIG. 15 is a partially enlarged view of another exploded view of a spraying device provided by an embodiment of the present disclosure.
Figure 16:
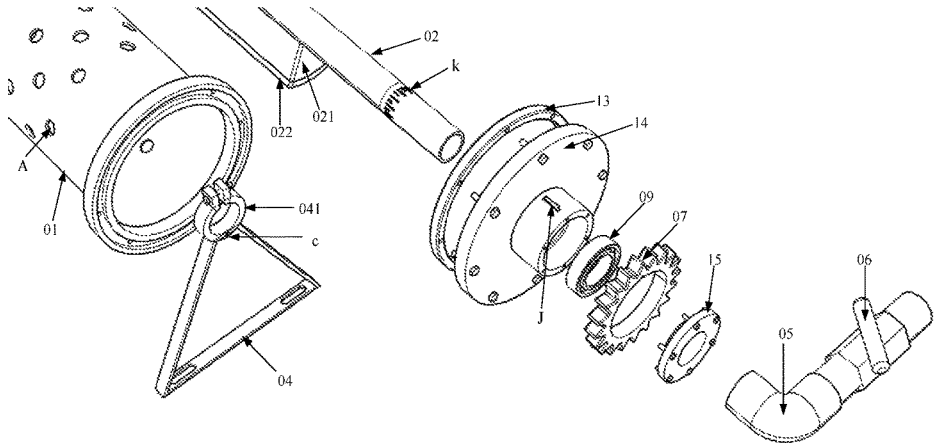
FIG. 16 is a partially enlarged view of an exploded view of a spraying device provided by an embodiment of the present disclosure.

FIGS. 15 and 16 are partial enlarged views of an exploded view of a spraying device 00 provided by an embodiment of the present disclosure. The spraying device 00 comprises a spraying mechanism and a rotation mechanism. See FIG. 15 (which shows the construction of the closed end of the spraying device 00), the spraying device 00 also comprises a first bearing 08, a first gasket 10, a first end cover 11 and a second end cover 12. The first end cover 11 and a second end cover 12 both are provided with openings (for passing through the infusion channel 02), and the first support frame 03 is provided with a first retaining ring 031. See FIG. 16 (which shows the construction of the open end of the spraying device 00), the spraying device 00 further comprises a gear 07, a second bearing 09, a second gasket 13, a third end cover 14 and a fourth end cover 15. The third end cover 14 and the fourth end cover 15 both are provided with openings (for passing through the infusion channel 02). The gear 07 is provided with teeth for receiving driving of the drive mechanism. The second support frame 04 is provided with a second retaining ring 041, and the control valve 06 is provided on the connecting pipe 05. The gear 07 is fixedly connected to the third end cover 14 by the engagement of the groove on the shaft hole thereon with the flat key J on the third end cover 14. The gear 07 is used to drive the rotating sidewall 01.

As shown in FIG. 16, the open end of the infusion channel 02 is provided with an angle scale k arranged along the circumference of the infusion channel 02, and the second retaining ring 041 is provided with an indicator c which can indicate the angle scale of the infusion channel 02. The angle scale indicated by the indicator indicates the angle of the angle between the longitudinal axial cross section of the spraying member of the infusion channel 02 and the vertical plane, indicating the spraying angle of the spraying spout.

Figure 17:
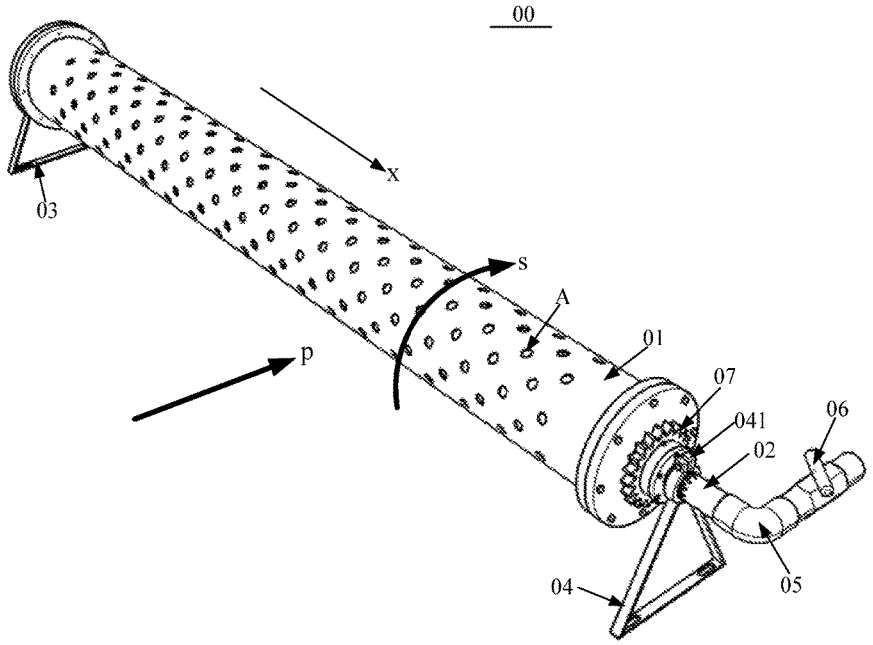
FIG. 17 is a view showing a use state of a spraying device according to an embodiment of the present disclosure.

FIG. 17 is a view showing the use state of the spraying device 00 provided in the embodiment of the present disclosure. See FIG. 17, the spraying device 00 is provided in the spraying chamber (not shown in FIG. 17) by the first support frame 03 and the second support frame 04 when in use. The infusion channel 02 of the spraying mechanism is communicated with the reservoir by the connecting pipe 05, and the valve opening degree of the control valve 06 is adjusted so that the liquid in the reservoir enters the infusion channel 02 through the connecting pipe 05 and enters the rotating sidewall 01 of the rotating mechanism through the spraying spout of the infusion channel 02. The rotating sidewall 01 is rotated about axis of the rotation sidewall 01 by the drive mechanism in the direction s shown in FIG. 17, so that the liquid entering the rotating sidewall 01 is sprayed from the different sets of spraying holes on the rotating sidewall 01, while the material to be cleaned passes under the spraying device 00 in the direction p shown in FIG. 17. In this process, the liquid sprayed from the different sets of spraying holes of the rotating sidewall 01 is sprayed to different areas of the material to be cleaned.

The rotation of the rotating sidewall 01 may be a rotation of a complete circumference or a rotation of a nonholonomic circumference, for example, a reciprocating motion within an angle. The angle is, for example, the angle centered on the spraying member 021. The rotating sidewall 01 may be an arc sidewall having a certain degree of curvature in the case of reciprocating rotational motion at an angle.

When the spraying angle of the spraying spout needs to be adjusted, the infusion channel 02 is driven by the angle adjusting mechanism to rotate about the axis of the infusion channel 02 and the spray angle of the spraying spout is observed by the angle scale on the infusion channel 02, so that the spraying angle of the spraying is adjusted to the desired spraying angle.

In view of the above, the embodiment of the present disclosure provides a spraying device which rotates the sidewall so that the spraying spout is aligned with different sets of spray holes at different times so that the liquid can be sprayed from the different sets of spray holes at different times, improving the uniformity of liquid spraying, with a good cleaning effect. The spraying device provided by the embodiment of the present disclosure can further improve the uniformity of liquid spraying by adjusting the rotational speed of the rotating sidewall.

In addition, the spraying device provided by the embodiment of the present disclosure solves the problem that the uniformity of the liquid spraying of the swing-type apparatuses in the prior art is poor. And since the rotating sidewall can be rotated at a uniform speed without acceleration or deceleration movement, the vibration of the spraying device is small, reducing the impact on product yield. And by setting the sealing wear-resistant parts, the problem of larger wear of the swing-type spraying apparatuses is further solved. In addition, the spraying device provided by the embodiment of the present disclosure can adjust the spray angle of the spraying spout of the infusion channel according to the need of the production process, so that the degree of scattering of the liquid spraying can be better controlled.

The foregoing is merely preferred embodiments of the present disclosure and is not intended to limit the disclosure, and any modifications, equivalent substitutions, improvements, and the like within the spirit and principles of the disclosure are intended to be encompassed by the protection scope of the disclosure. It should be noted that the wording "comprising" does not exclude the presence of elements or steps not listed in the claims. The phrase 'a' or 'an' in front of an element does not exclude the presence of multiple such elements. The mere fact that certain measures are recited in mutually different dependent claims does not indicate that the combination of these measures cannot be used for advantage. Any reference signs in the claims should not be construed as limiting the scope.

The invention claimed is:

1. A spraying device comprising: a spraying mechanism and a rotating mechanism, wherein the rotating mechanism comprises a rotating sidewall with a plurality of sets of spraying holes arranged along a circumference of the rotating sidewall; each of the plurality of sets of spraying holes comprises a plurality of spraying holes, and the spraying holes of at least two adjacent sets of spraying holes are arranged in a staggered arrangement;

wherein the spraying mechanism comprises an infusion channel, a sidewall of which is provided with a spraying spout;

wherein the infusion channel extends along inside of the rotating sidewall, the rotating sidewall being configured to rotate or swing with respect to the spraying spout of the infusion channel;

wherein the infusion channel is provided with a spraying member comprising a first opening, a second opening and a closed sidewall, the first opening connecting the spraying spout, the second opening facing the rotating sidewall; and wherein the spraying member has an elongated structure and has a fan-shaped cross-section in a direction perpendicular to a lengthwise direction of the infusion channel.

2. The spraying device according to claim 1, wherein the rotating sidewall has a barrel structure or an arc sidewall having a radian, and the plurality of spraying holes in each set of spraying holes are arranged along a lengthwise direction of the rotating sidewall.

3. The spraying device according to claim 2, further comprising an angle adjustment mechanism disposed on the infusion channel for adjusting a spraying angle of the spraying spout of the infusion channel.

4. The spraying device according to claim 2, wherein the infusion channel has a round tubular structure with one end open and the other end closed, and the spraying spout is an elongated spraying spout with a lengthwise direction parallel to the lengthwise direction of the infusion channel.

5. The spraying device according to claim 4, further comprising an angle adjustment mechanism is disposed on the infusion channel for adjusting a spraying angle of the spraying spout of the infusion channel.

6. The spraying device according to claim 4, wherein the lengthwise direction of the infusion channel is parallel to the lengthwise direction of the rotating sidewall, and the rotating sidewall is configured to rotate or swing relative to the spraying spout to align the spraying spout with different sets of spraying holes at different times.

7. The spraying device according to claim 6, further comprising an angle adjustment mechanism disposed on the infusion channel for adjusting a spraying angle of the spraying spout of the infusion channel.

8. The spraying device according to claim 1, wherein an edge of the second opening in the spraying member is provided with a wear-resistant member, and the spraying member is in contact with the rotating sidewall through the wear-resistant member.

9. The spraying device according to claim 1, wherein the spraying holes are evenly distributed on the rotating sidewall.

10. The spraying device according to claim 1, wherein the second opening is an elongated opening, a length of the second opening being less than or equal to a length of the rotating sidewall.

11. The spraying device according to claim 1, further comprising an angle adjustment mechanism disposed on the infusion channel for adjusting a spraying angle of the spraying spout of the infusion channel.

12. The spraying device according to claim 1, further comprising a first support frame and a second support frame, the first support frame being provided with a first retaining ring, the second support frame being provided with a second retaining ring;

wherein the infusion channel comprises a closed end secured to the first support frame by means of the first retaining ring, and an open end secured to the second support frame by means of the second retaining ring.

13. The spraying device according to claim 12, further comprising a first bearing, a second bearing, a first end cover, and a second third end cover, wherein the closed end of the infusion channel is connected to the first bearing, the open end of the infusion channel is connected to the second bearing, and the first bearing and the second bearing are respectively provided in center holes of the first end cover and the third end cover, and the first end cover and the third end cover are respectively fixedly connected to the rotating sidewall.

14. The spraying device according to claim 13, further comprising a transmission mechanism disposed on the first end cover or the third end cover.

15. The spraying device according to claim 14, wherein the transmission mechanism is a gear or pulley, and the transmission mechanism is fixedly connected to the first end cover or the third end cover by a key-and-slot connection.

16. The spraying device according to claim 1, further comprising a connecting pipe and a control valve, wherein the infusion channel comprises a closed end and an open end, the open end connecting to one end of the connecting pipe, and the control valve is arranged on the connecting pipe;

wherein the infusion channel is configured to, upon operation of the spraying device be communicated with a reservoir through the connecting pipe via the open end; and wherein the control valve is configured to control a flow of a sprayed liquid through the connecting pipe.

* * * * *